US006818874B2

(12) United States Patent
Jeong

(10) Patent No.: US 6,818,874 B2
(45) Date of Patent: Nov. 16, 2004

(54) WALL-MOUNTED TYPE MICROWAVE OVEN

(75) Inventor: Sang-Jin Jeong, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 205 days.

(21) Appl. No.: 10/225,144

(22) Filed: Aug. 22, 2002

(65) Prior Publication Data

US 2003/0218011 A1 Nov. 27, 2003

(30) Foreign Application Priority Data

May 27, 2002 (KR) ..... 10-2002-29337

(51) Int. Cl.[7] ..... H05B 6/80; F24C 15/20

(52) U.S. Cl. ..... 219/757; 219/756; 99/21 A; 99/299 R

(58) Field of Search ..... 219/757, 756, 219/681; 126/21 A, 21 R, 299 R, 299 D

(56) References Cited

U.S. PATENT DOCUMENTS 4,266,528 A * 5/1981 Barnhart et al. ..... 126/299 D
4,418,261 A * 11/1983 Jailor et al. ..... 219/757
4,786,774 A * 11/1988 Kaminaka ..... 219/757
5,500,508 A * 3/1996 Gerl ..... 219/400
5,981,929 A * 11/1999 Maeda et al. ..... 219/757
6,291,809 B1 9/2001 Ha ..... 219/757

* cited by examiner

*Primary Examiner*—Philip H. Leung
(74) *Attorney, Agent, or Firm*—Staas & Halsey LLP

(57) ABSTRACT

A wall-mounted type microwave oven includes an exhaust fan assembly which increases an internal cooking chamber volume and allows a facing direction of its outlet to be easily changed. The exhaust fan assembly includes a fan case having an exhaust fan therein and a guide duct positioned on a side face of the fan case to guide exhaust gas toward the fan case. A lower portion of the fan case is disposed between the cooking chamber and the oven body, and communicates with an exhaust path of the microwave oven. An upper portion of the fan case protrudes upward from the oven body. Accordingly, a height of the cooking chamber is increased by a protruded height of the fan case. The fan case is shaped to have a square section and to have an inlet and an outlet at its side face and upper surface. The outlet of the fan case can be directed to a desired direction by separating the fan case from the oven body and fitting the fan case into the oven body with the outlet being directed to face the desired direction.

20 Claims, 8 Drawing Sheets

WALL-MOUNTED TYPE MICROWAVE OVEN

CROSS-REFERENCE TO RELATED APPLICATIONS

This application claims the benefit of Korean Patent Application No. 2002-29337 filed on May 27, 2002, in the Korean Industrial Property Office, the disclosure of which is incorporated herein by reference.

BACKGROUND OF THE INVENTION

1. Field of the Invention

The present invention relates to a wall-mounted type microwave oven, and more particularly, to a wall-mounted type microwave oven having an exhaust fan assembly which upwardly protrude s from an oven body so as to enlarge an internal volume of a cooking chamber. The exhaust fan assembly is detachably coupled to an oven body of the microwave oven to easily change a discharging direction of exhaust gas.

2. Description of the Related Art

FIG. 1 shows a conventional wall-mounted type microwave oven 1 installed over an oven range 2. Generally, the wall-mounted type microwave oven 1 exhausts gas and fumes generated from the oven range 2 to the outside, and cooks food therein using high-frequency electromagnetic waves.

The oven range 2 is provided at its top with a plurality of top burners 3 to cook food, for example, by combustion of gas. The wall-mounted type microwave oven 1 is adapted to cook food in a cooking chamber (not shown) by an intermolecular frictional heat which is generated by repeatedly agitating water molecules of the food with high-frequency electromagnetic wave energy generated from a magnetron (not shown).

FIG. 2 schematically shows an internal configuration of the wall-mounted type microwave oven 1. The wall-mounted microwave oven 1 includes an exhaust path 13 to suck in exhaust gas and odors generated from cooking of the food and to discharge them to the outside, and a cooking chamber 11 and an electrical component compartment 12, which are isolated from each other in an oven body 10.

The cooking chamber 11 and the electrical component compartment 12 are provided at their bottoms, sides and tops with the exhaust path 13 to exhaust the gas and fumes generated from the oven range 2 (see FIG. 1) disposed below the wall-mounted type microwave oven 1. The oven body 10 is provided at an upper portion of its back with an exhaust fan 14 which sucks in the exhaust gas and fumes introduced into the exhaust path 13, and discharges them to the outside. The exhaust path 13 constitutes a flow path isolated from the cooking chamber 11 and the electrical component compartment 12.

The electrical component compartment 12 includes a cooling fan 15 which cools electric components disposed in the electrical component compartment 12. The electrical component compartment 12 is further provided at an upper portion of its front face with a front air inlet 16, which allows outside air to be introduced into the electrical component compartment 12 therethrough by operation of the cooling fan 15. A partition plate 17 which is located between the cooking chamber 11 and the electrical component compartment 12 is formed with a plurality of vent holes 18, so as to introduce air sucked into the electrical component compartment 12 into the cooking chamber 11 therethrough to ventilate the cooking chamber 11. The cooking chamber 11 is formed with a plurality of vent holes 19 at its upper surface and on the side opposite to the partition plate 17 to allow the air in the cooking chamber 11 to be discharged to the outside therethrough. The cooking chamber 11 is also provided with a front air outlet 20 which allows the air passing through the vent holes 19 to be discharged to the outside therethrough.

However, since the exhaust fan 14 is internally provided at an upper portion of the oven body 10, a portion of the oven body is necessarily reserved to accommodate the exhaust fan 14. Accordingly, the internal volume of the cooking chamber 11 is reduced by a height required to accommodate the exhaust fan 14. Therefore, the internal space of the wall-mounted type microwave oven 1 is not efficiently employed.

In addition, when the wall-mounted type microwave oven 1 is installed, a discharging outlet 14*b* of the exhaust fan 14 is required to be directed to one of forward, upward and rearward directions in accordance with an orientation of a discharging duct (not shown), which guides the exhaust gas to the outside. However, since the exhaust fan 14 of the conventional wall-mounted type microwave oven 1 is housed in the oven body 10, the oven body 10 must be dismantled in order to change a discharging direction of the exhaust gas. Therefore, with the conventional wall-mounted type microwave oven 1, changing of the discharging direction requires an inconvenient and time-consuming operation.

SUMMARY OF THE INVENTION

Accordingly, it is an object of the present invention is to provide a wall-mounted type microwave oven having an improved exhaust fan assembly structure which increases an internal volume of a cooking chamber, and easily allows a change of a discharging direction of exhaust gas.

Additional objects and advantages of the invention will be set forth in part in the description which follows and, in part, will be obvious from the description, or may be learned by practice of the invention.

To achieve the above and other objects of the present invention, there is provided a wall-mounted type microwave oven comprising an oven body having a discharging outlet formed thereon, a cooking chamber partitioned in the oven body, an exhaust path defined between the oven body and the cooking chamber, and an exhaust fan assembly detachably coupled to the discharging outlet of the oven body, wherein an upper portion of the exhaust fan assembly protrudes from the oven body.

The exhaust fan assembly may comprise a fan case containing an exhaust fan therein, and a guide duct positioned on a side face of the fan case to guide exhaust gas toward the fan case.

A lower portion of the fan case may be disposed between a top wall of the cooking chamber and a top panel of the oven body, and communicates with the exhaust path. An upper portion of the fan case may protrude from the top panel of the oven body, so as to increase a chamber dimension of the cooking chamber by a distance of the protrusion of the fan case.

The fan case may include an inlet formed on the side face of the fan case and an outlet formed on an upper surface of the fan case. The outlet of the fan case may be directed to face one of upward, downward, forward, and rearward with respect to the oven body by separating the fan case from the oven body and fitting the fan case into the oven body to change a facing direction of the outlet.

The guide duct may be positioned so as to have its side face be in contact with an upper portion of the side face of the fan case protruding from the top panel of the oven body, and its lower end fitted into the discharging outlet of the oven body, so as to guide the exhaust gas discharged from the discharging outlet toward the upper portion of the fan case.

BRIEF DESCRIPTION OF THE DRAWINGS

These and other objects and advantages of the present invention will become apparent and more readily appreciated from the following description of the embodiments, taken in conjunction with the accompanying drawings of which:

FIGS. 6A to 6C are cross-sectional views of the wall-mounted type microwave oven shown in FIG. 4, in which FIG. 6A shows an outlet of the exhaust fan assembly facing upward, FIG. 6B shows the outlet of the exhaust fan assembly facing rearward, and FIG. 6C shows the outlet of the exhaust fan assembly facing forward with respect to the oven body.

DETAILED DESCRIPTION OF THE PREFERRED EMBODIMENTS

Figure 1:
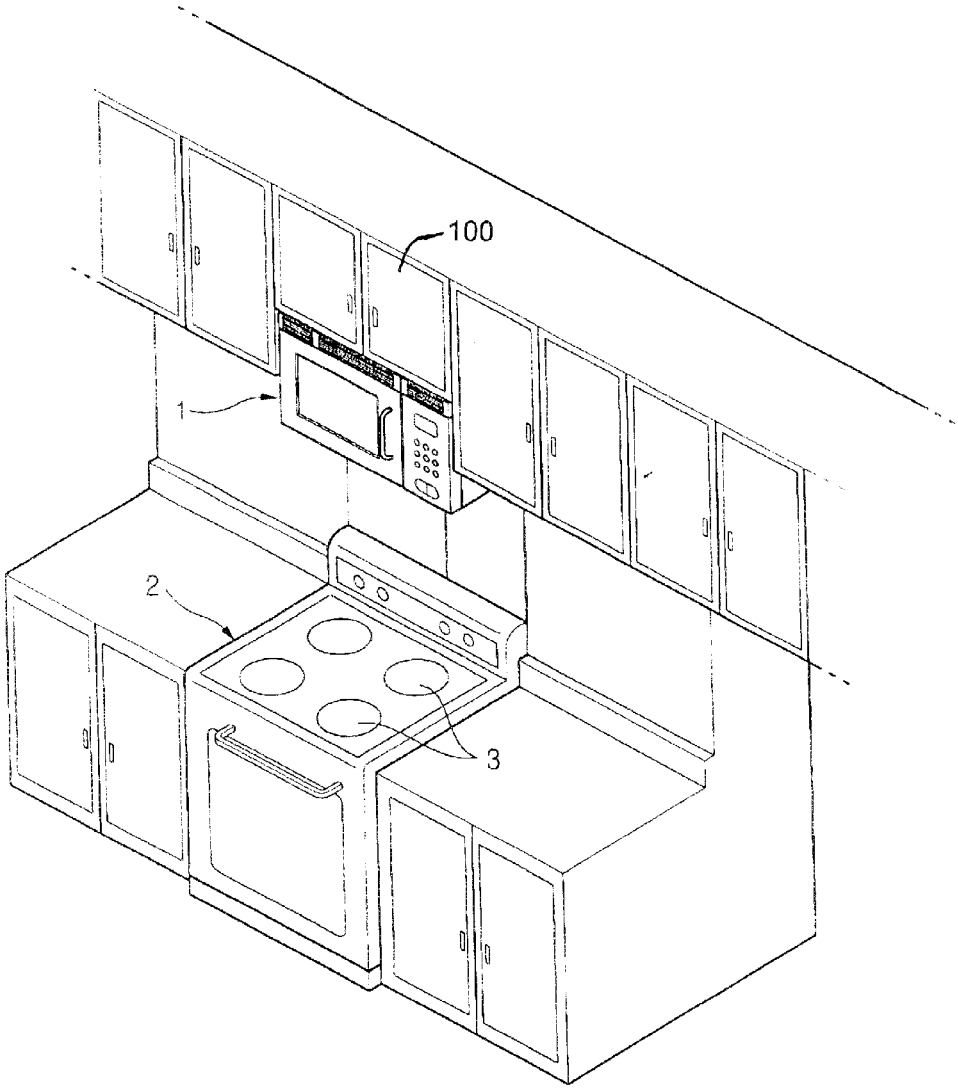
FIG. 1 (Prior Art)
FIG. 1 is a perspective view of a conventional wall-mounted type microwave oven, which is installed above an oven range.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 3:
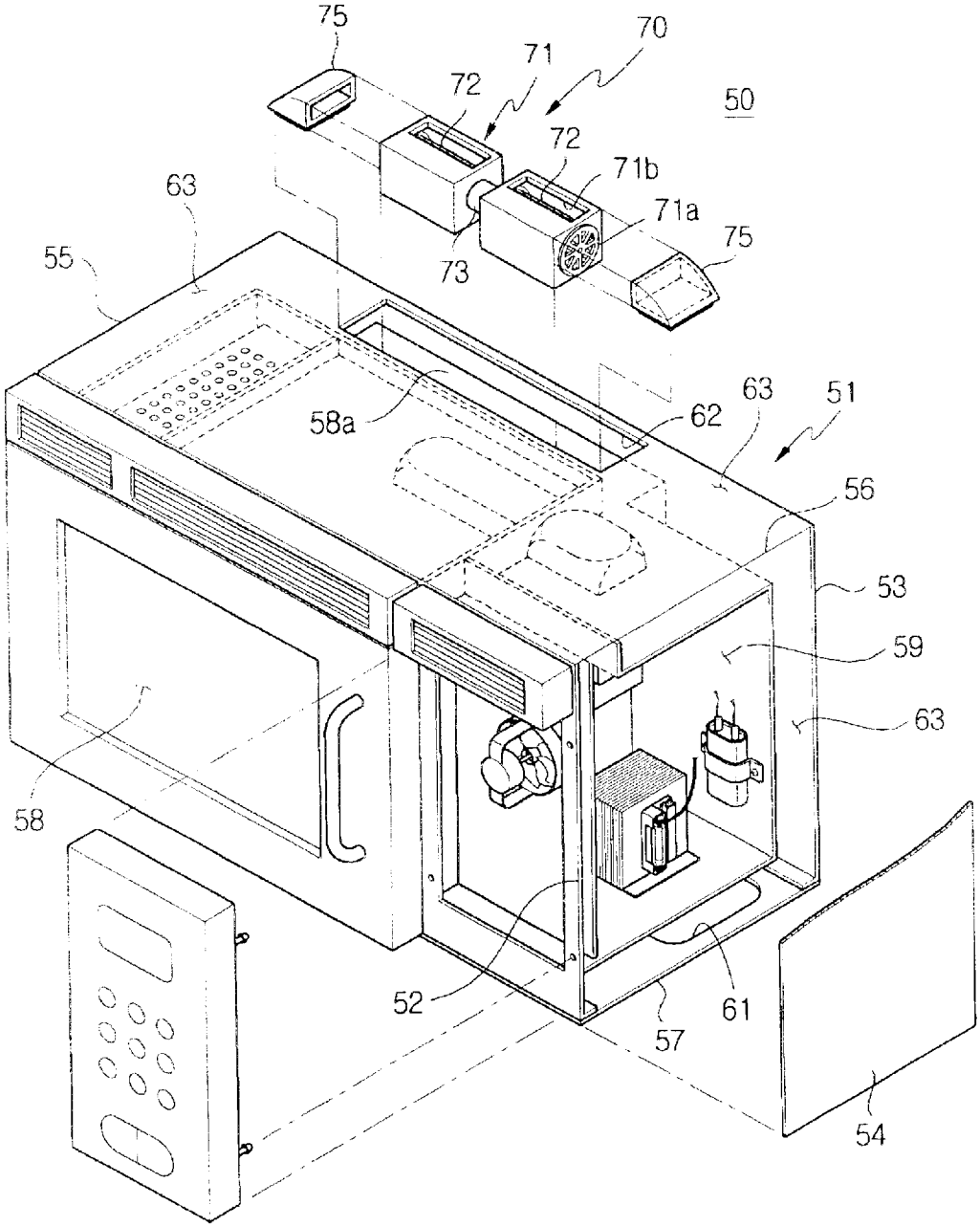
FIG. 3 is a perspective view of a wall-mounted type microwave oven according to an embodiment of the present invention, in which an exhaust fan assembly is separated from an oven body.
Figure 4:
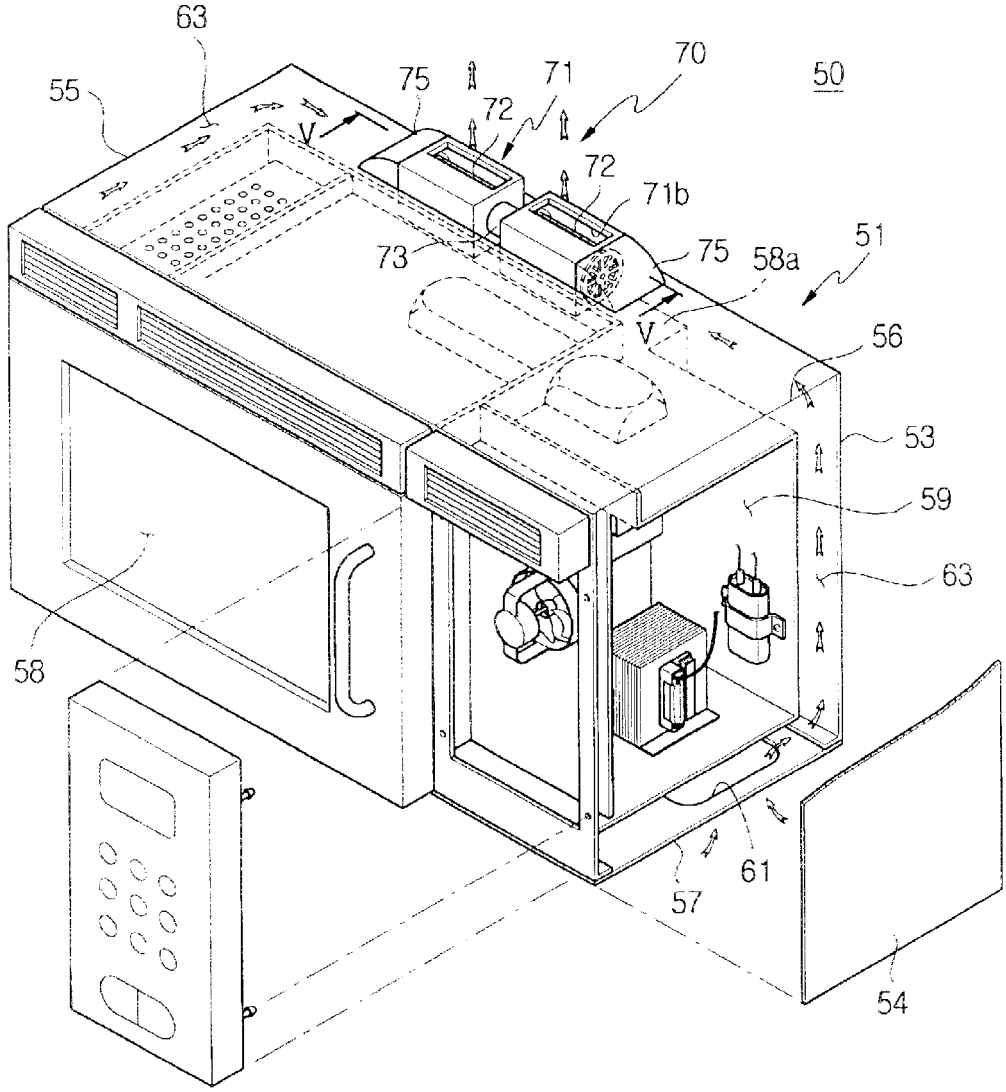
FIG. 4 is a perspective view of the wall-mounted type microwave oven shown in FIG. 3, in which the exhaust fan assembly is attached to the oven body.
Figure 5:
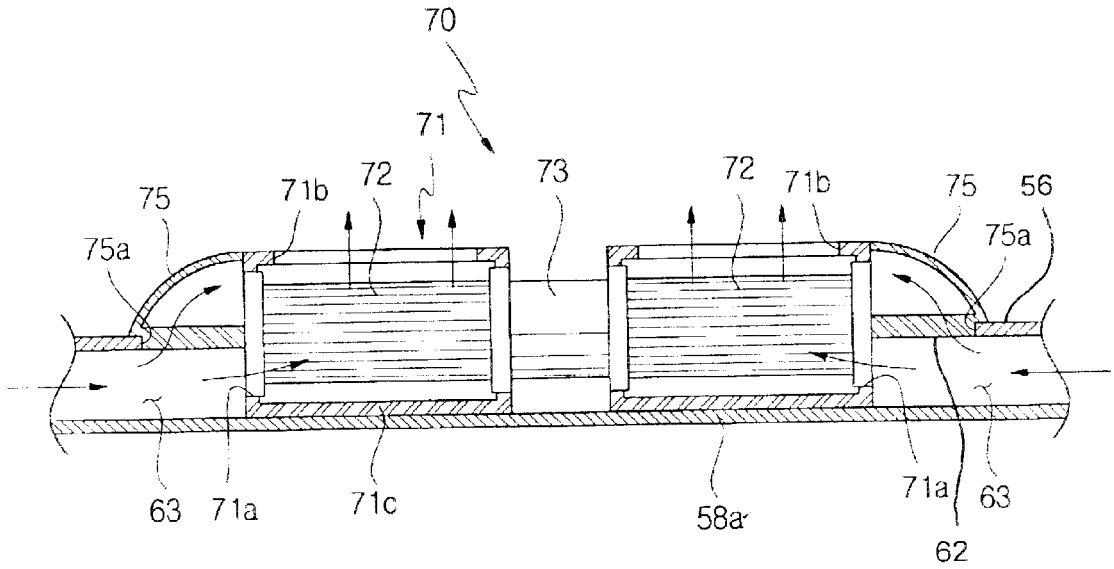
FIG. 5 is a cross-sectional view taken along line V—V of FIG. 4.

FIG. 3 shows a perspective view of a wall-mounted type microwave oven 50 according to an embodiment of the present invention, in which an exhaust fan assembly 70 is separated from the microwave oven 50. FIG. 4 shows a perspective view of the wall-mounted type microwave oven 50, in which the exhaust fan assembly 70 is attached to the microwave oven 50. FIG. 5 shows a cross-sectional view taken along line V—V of FIG. 4.

The wall-mounted type microwave oven 50 according to the present invention includes a box-shaped oven body 51 having front and rear panels 52 and 53, side panels 54 and 55, and top and bottom panels 56 and 57. The oven body 51 is provided therein with a cooking chamber 58 and an electrical component compartment 59, which are isolated from each other, to cook food using high-frequency electromagnetic waves.

The bottom plate 57 includes intake ports 61 which allow exhaust gas and odors of food generated from an oven range 2 (see FIG. 1) to be introduced into the oven body 51 therethrough. The top panel 56 includes a discharging outlet 62 which allows the exhaust gas and odors introduced into the oven body 51 to be discharged therethrough.

The intake ports 61 and the discharging outlet 62 communicate with each other through an exhaust path 63, which is defined between the cooking chamber 58 and the electric component compartment 59, and the rear and top panels 53 and 56, so as to guide the exhaust gas and odors introduced into the intake port 61, and discharge the exhaust gas and odors to the outside through the discharging outlet 62.

The exhaust fan assembly 70 comprises a pair of fan cases 71, each of which includes an exhaust fan 72 therein to suck the exhaust gas and odors introduced through the intake ports 61 of the bottom panel 57, and a pair of guide ducts 75 coupled to corresponding outer ends of the fan cases 71 to guide the exhaust gas and odors toward the exhaust fans 72. A fan motor 73 is disposed between the fan cases 71, and drives the exhaust fans 72. Accordingly, the exhaust fan assembly 70 according to the present invention is symmetrically configured with respect to the fan motor 73.

Each of the fan cases 71 is shaped to have a square section and is provided at its side surface with an inlet 71*a*, which allows the exhaust gas and odors introduced into the guide duct 75 to be directed to the exhaust fan 72. Each of the fan cases 71 is also provided at its upper surface with an outlet 71*b*, which allows the exhaust gas and odors introduced into the fan case 71 to be discharged to the outside.

Each of the guide ducts 75 is shaped to have an arched section when viewed from the front, and is constructed to have a flow path therein. Lower ends of the guide ducts 75 are fitted into the discharging outlet 62 to communicate with the exhaust path 63, and side faces of the guide ducts 75 come into contact with the corresponding side surfaces of the fan cases 71 to communicate with the corresponding inlets 71*a* of the fan cases 71.

As shown in FIG. 4, the fan cases 71 and the guide ducts 75 are fitted into the discharging outlet 62 formed at the top panel 56 of the oven body 51, so as to discharge the exhaust gas and odors, which are introduced into the exhaust fan assembly 70 through the intake ports 61 and the exhaust path 63, upward.

Assembling and disassembling operations of the exhaust fan assembly 70 with respect to the discharging outlet 62 of the oven body 51 are described below with reference to FIG. 5.

As shown in FIG. 5, the guide ducts 75 are fitted into opposite ends of the discharging outlet 62 to position the fan cases 71 with respect to the discharging outlet 62 of the oven body 51. At this point, since the guide ducts 75 are formed with corresponding stepped portions 75*a* at outer sides of their lower ends, the stepped portions 75*a* of the guide ducts 75 are engaged with the opposite ends of the discharging outlet 62. Accordingly, the guide ducts 75 are fixedly fitted in the discharging outlet 62.

Where the guide ducts 75 are fitted into the discharging outlet 62, a space is defined between the guide ducts 75, which is necessary to receive the fan cases 71. Accordingly, where the fan cases 71 are fitted into the discharging outlet 62 between the guide ducts 75, bottom faces 71*c* of the fan cases 71 come into contact with a top surface 58*a* of the cooking chamber 58, and the exhaust fan assembly 70 is securely assembled to the discharging outlet 62 of the oven body 51.

Where the exhaust fan assembly 70 is fitted into the discharging outlet 62, lower portions of the fan cases 71 are disposed in the exhaust path 63 and upper portions of the fan cases 71 are upwardly protruded from the top panel 56 of the oven body 51. At this point, the guide ducts 75 are fitted in the discharging outlet 62 such that the stepped portions 75*a* of the guide ducts 75 are placed on edges of the oven body 51 defining the opposite ends of the discharging outlet 62.

With the assembly described above, as the exhaust fan 72 is operated, a part of the exhaust gas introduced into the exhaust path 63 is directly introduced into the fan cases 71 through respective lower portions of the inlets 71*a* of the fan cases 71, and the other part of the exhaust gas in the exhaust path 63 is guided into the guide ducts 75 and introduced into the fan cases 71 through respective upper portions of the inlets 71*a*.

The exhaust fan assembly 70 of the present invention, which is assembled on the oven body 51, can be easily disassembled. For example, the exhaust fan assembly 70 can be disassembled by removing the guide ducts 75, which protrude upward from the oven body 51, and pulling out the fan cases 71 from the discharging outlet 62. On the other hand, only the fan cases 71 may be separated from the oven body 51 by pulling the fan cases 71 out of the discharging outlet 62 without removing the guide ducts 75.

As described above, since the exhaust fan assembly 70 is assembled on the oven body 51 with the upper portion of the exhaust fan assembly 70 protruding upward, an internal volume of the cooking chamber 58 can be increased by a protruding height increment of the protruding portion of the exhaust fan assembly 70 without enlarging the oven body 51. Therefore, the wall-mounted type microwave oven of the present invention, which has the same oven body dimension as a conventional wall-mounted type microwave oven, can have a larger cooking chamber capacity than that of the conventional wall-mounted type microwave oven.

In addition, since the exhaust fan assembly 70 can be easily assembled and disassembled without dismantling the oven body 50, its maintenance is convenient, and its assembly and disassembly does not require a lengthy period of time.

Figure 2:
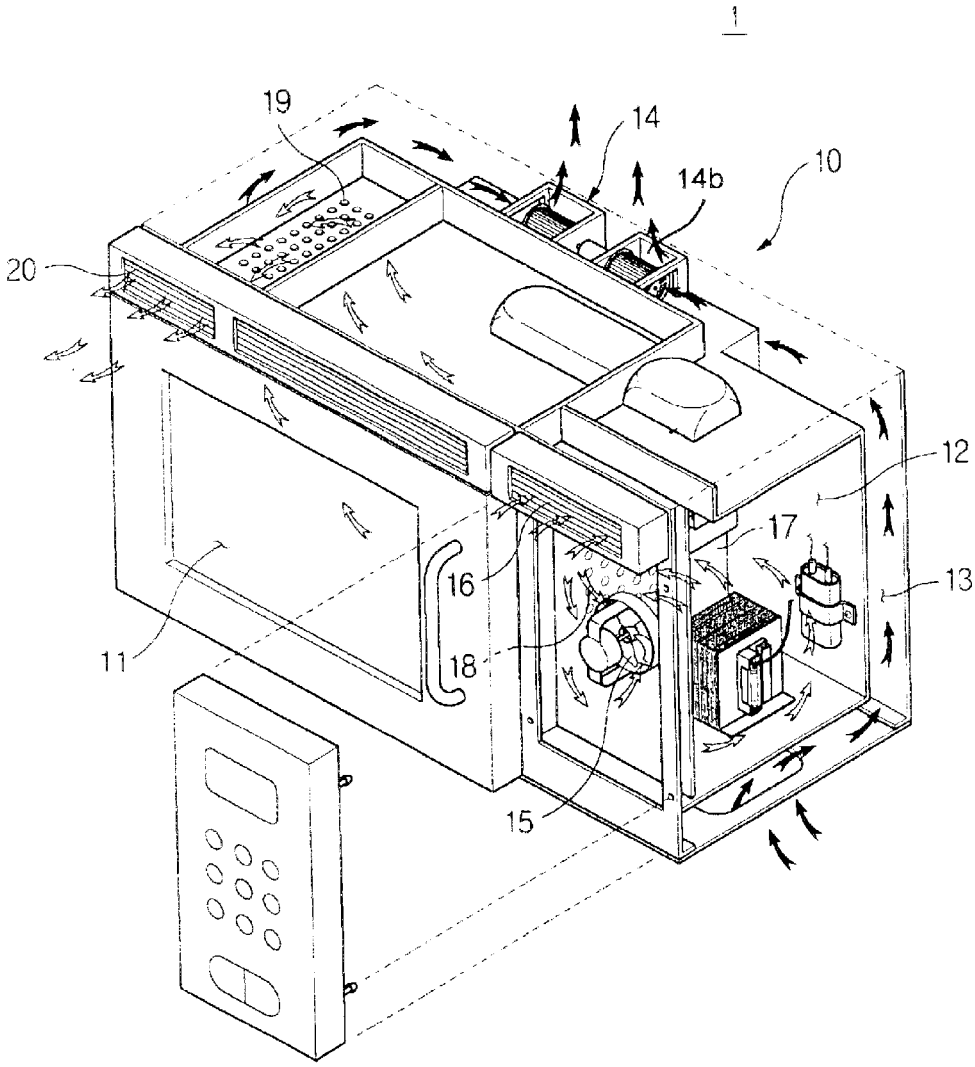
FIG. 2 (Prior Art)
FIG. 2 is a perspective view of the conventional wall-mounted type microwave oven shown in FIG. 1, which is equipped with an exhaust path to guide exhaust gas generated from the oven range.

Generally, as shown collectively in FIGS. 1 and 2, the wall-mounted type microwave oven 1 is mounted on a wall of a kitchen, and its upper surface is positioned to be in contact with a kitchen cabinet 100. Accordingly, a lower plate (not shown) of the kitchen cabinet 100 is provided with an exhaust hole (not shown) corresponding to the discharging outlet 14*b* of an oven body of the wall-mounted type microwave oven 1, so as to discharge exhaust gas introduced into the oven body to the outside through an exhaust duct (not shown) connected to the exhaust hole of the kitchen cabinet 100.

With reference to FIGS. 3 and 4, where the wall-mounted type microwave oven 50 of the present invention is firmly coupled to the lower plate of the kitchen cabinet 100, the exhaust fan assembly 70 may be coupled to or separated from the discharging outlet 62 of the oven body 51 through the exhaust hole of the kitchen cabinet 100. Since such coupling and separating operations of the exhaust fan assembly 70 are substantially identical to that described above with reference to FIGS. 3 to 5, detailed descriptions thereof are omitted to avoid repetition.

Figure 6A:
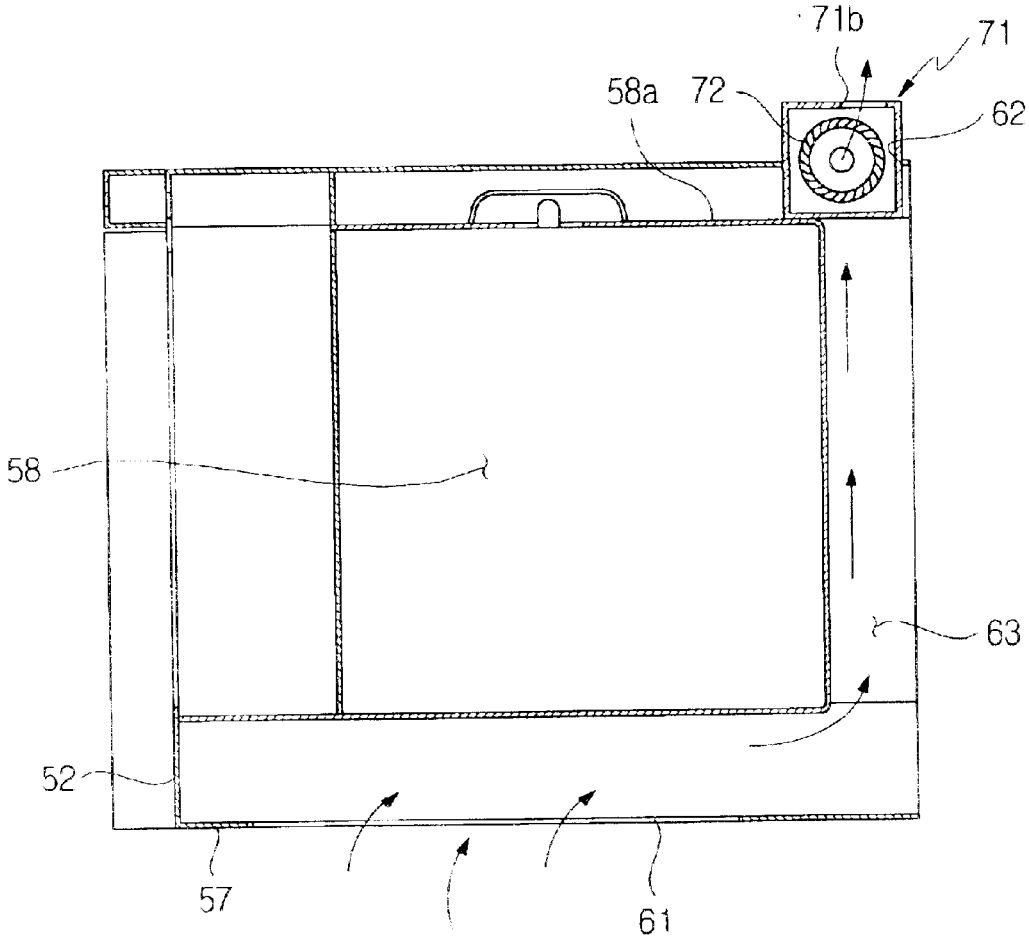
Figure 6B:
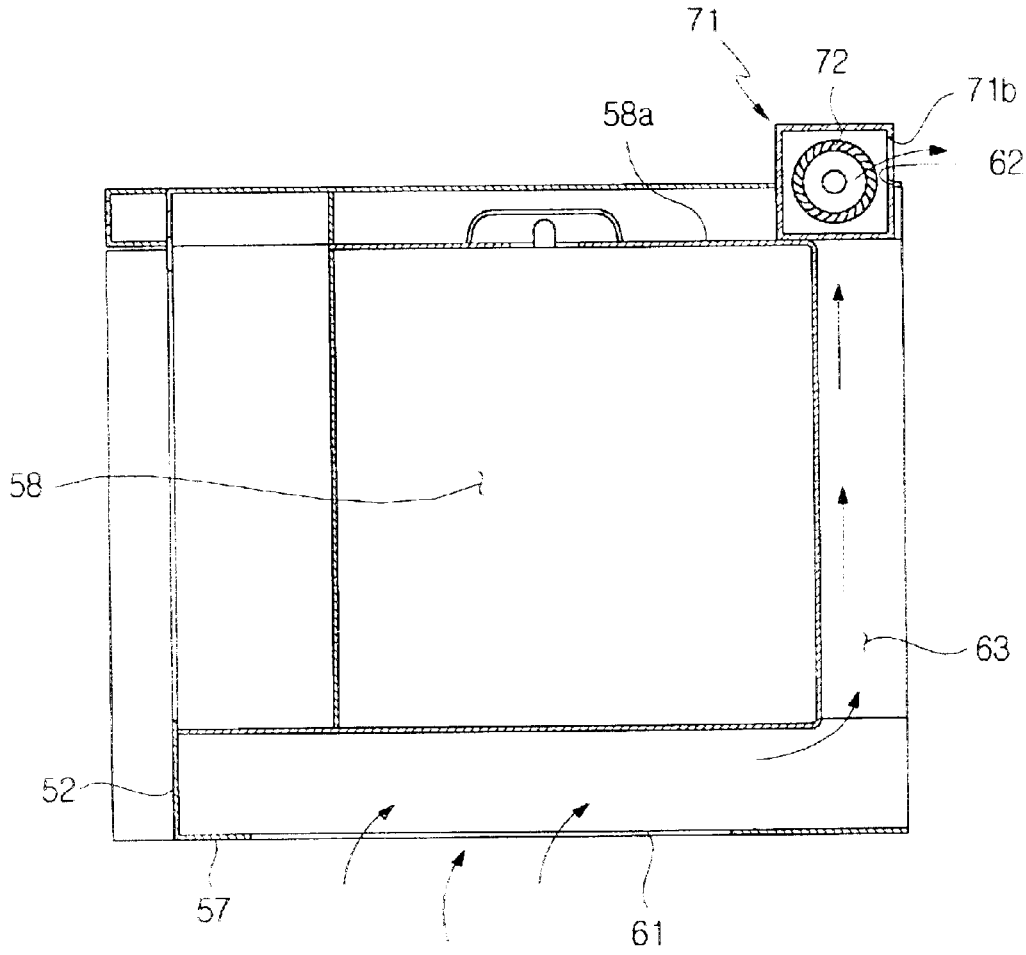
Figure 6C:
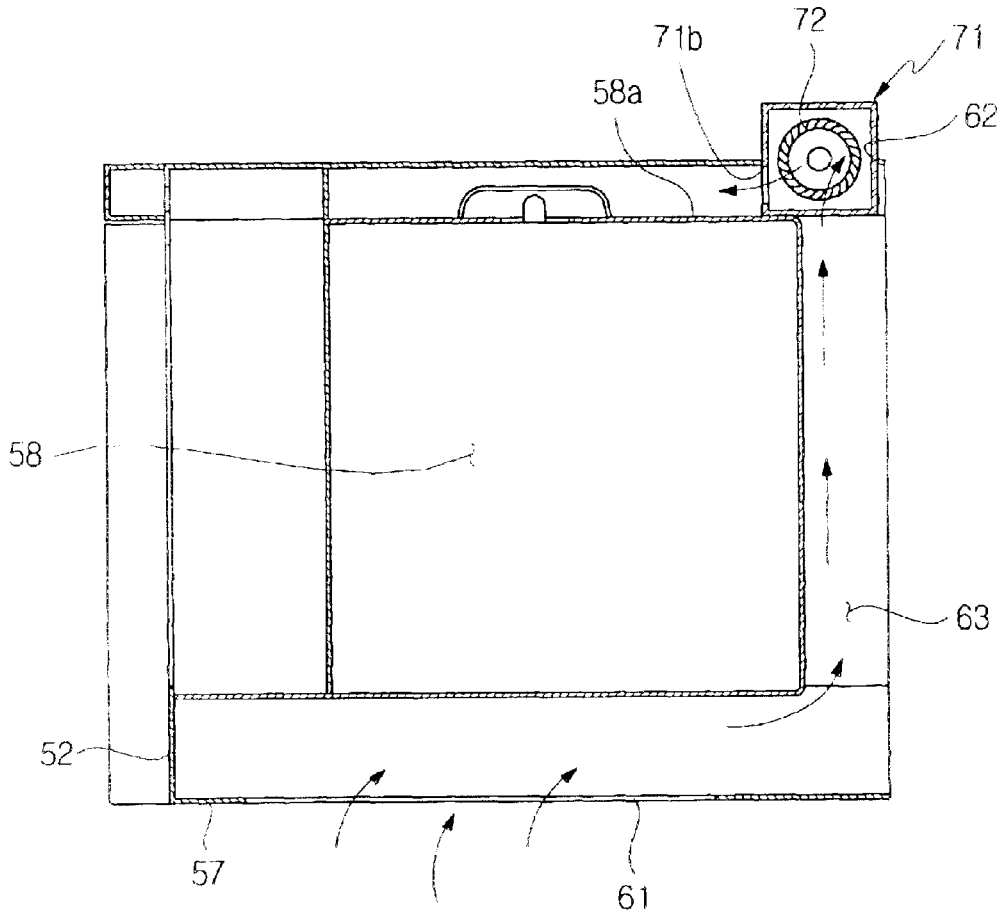

FIGS. 6A to 6C illustrate an adjustable discharging direction of the exhaust fan assembly 70 according to the present invention. FIG. 6A shows the exhaust fan assembly 70 with the outlets 71*b* facing upward, FIG. 6B shows the exhaust fan assembly 70 with the outlets 71*b* facing rearward, and FIG. 6C shows the exhaust fan assembly 70 with the outlets 71*b* facing forward.

As shown in FIG. 6A, where the fan cases 71 of the exhaust fan assembly 70 are fitted into the discharging outlet 62 of the oven body 51 in a manner shown in FIG. 4, the outlets 71*b* of the fan cases 71 face upward. In this case, exhaust gas introduced into the fan cases 71 through the inlets 71*a* (see FIG. 5) by the exhaust fans 72 is discharged upward through the outlets 71*b*. The outlets 71*b*, which face upward, communicate with an exhaust duct (not shown) to guide the exhaust gas upward.

As shown in FIG. 6B, where the fan cases 71 are fitted into the discharging outlet 62 of the oven body 51 such that the outlets 71*b* of the fan cases 71 face rearward, the exhaust gas is guided to a rear of the wall-mounted type microwave oven 50. The exhaust gas which is introduced into the fan cases 71 through the inlets 71*a* by the operation of the exhaust fans 72 is rearwardly discharged through the outlets 71*b* facing rearward. The exhaust gas discharged from the outlets 71*b* of the fan cases 71 is guided to the outside by an exhaust duct (not shown) which communicates with the outlets 71.

To direct the exhaust gas, which discharged from the oven body 51, toward the room via a filtering treatment, the fan cases 71 can be fitted into the discharging outlet 62 of the oven body 51 such that the outlets 71*b* of the fan cases 71 are positioned to face forward, as shown in FIG. 6C. Consequently, the exhaust gas, which is introduced into the fan cases 71 through the inlets 71*a* by the operation of the exhaust fan 72, is discharged forwardly through the outlets 71*b* facing forward. This orientation of the fan cases 71 may be desired where the exhaust gas is to be discharged to the room via the filtering treatment.

While a wall-mounted type microwave oven according to the present invention has been described to have a pair of exhaust fans to suck in the exhaust gas through sides of the oven body, and a fan motor disposed between the exhaust fans, it is understood that the wall-mounted type microwave oven may have a fan motor and an exhaust fan to suck in the exhaust gas through one side of the oven body.

As described above, a wall-mounted type microwave oven of the present invention is provided at its top with an exhaust fan assembly which protrudes upward from an oven body to increase an internal volume of a cooking chamber. Therefore, the wall-mounted type microwave oven according to the present invention can accommodate a larger amount of foods as compared to a conventional wall-mounted type microwave oven while having the same outer body dimension as the conventional wall-mounted type microwave oven.

In addition, since the wall-mounted type microwave oven according to the present invention has an exhaust fan assembly, which can be easily attached to and separated from the oven body without dismantling the oven body, maintenance of the exhaust fan assembly is convenient, and an operation of adjusting a direction of an outlet of the exhaust fan assembly is easily carried out.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A wall-mounted type microwave oven comprising:

an oven body having a discharging outlet formed thereon;

a cooking chamber partitioned in the oven body;

an exhaust path defined between the oven body and the cooking chamber; and an exhaust fan assembly detachably coupled to the discharging outlet of the oven body and including a fan case, wherein an upper portion of the exhaust fan assembly protrudes from the oven body, wherein the fan case includes:

a lower portion which is disposed between a top wall of the cooking chamber and a top panel of the oven body, and communicates with the exhaust path; and an upper portion which protrudes from the top panel of the oven body, so as to increase a chamber dimension of the cooking chamber by a distance of the protrusion of the fan case.

2. The wall-mounted type microwave oven of claim 1, wherein the exhaust fan assembly further comprises:

an exhaust fan contained in the fan case; and a guide duct positioned on a side face of the fan case to guide exhaust gas toward the fan case.

3. The wall-mounted type microwave oven of claim 2, wherein:

the fan case includes an inlet formed on the side face of the fan case and an outlet formed on an upper surface of the fan case, and the outlet of the fan case is directed to face one of upward, downward, forward, and rearward with respect to the oven body by separating the fan case from the oven body and fitting the fan case into the oven body to change a facing direction of the outlet.

4. The wall-mounted type microwave oven of claim 2, wherein the exhaust fan assembly further comprises a fan motor which drives the exhaust fan.

5. The wall-mounted type microwave oven of claim 1, wherein the guide duct comprises:

a side face which is positioned to contact with an upper portion of the side face of the fan case protruding from the top panel of the oven body; and a lower end which is fitted into the discharging outlet of the oven body, so as to guide the exhaust gas discharged from the discharging outlet toward the upper portion of the fan case.

6. The wall-mounted type microwave oven of claim 1, further comprising:

a magnetron which generates high-frequency electromagnetic waves;

a waveguide which guides the high-frequency electromagnetic waves generated from the magnetron to the cooking chamber; and an intake port which introduces exhaust gas generated below the oven body to the exhaust path.

7. The wall-mounted type microwave oven of claim 1, wherein the exhaust fan assembly communicates with the exhaust path and includes an outlet to discharge exhaust gas introduced into the exhaust path.

8. The wall-mounted type microwave oven of claim 7, wherein the exhaust fan assembly is detachable from the discharging outlet so as to change an orientation of the outlet.

9. A wall-mountable cooking apparatus comprising:

an oven body having a discharging outlet formed thereon;

a heating unit to cook food; and an exhaust fan assembly which protrudes from the oven body, is rotatably coupled to the discharging outlet, and includes a fan case, wherein the fan case includes a lower portion which is disposed between a top wall of the cooking chamber and a top panel of the oven body, and communicates with the exhaust path; and an upper portion which protrudes from the top panel of the oven body, so as to increase a chamber dimension of the cooking chamber by a distance of the protrusion of the fan case.

10. The wall-mountable cooking apparatus of claim 9, wherein the protrusion of the exhaust fan assembly increases a chamber dimension of the cooking chamber.

11. The wall-mountable cooking apparatus of claim 9, wherein the exhaust fan assembly includes an outlet which guides exhaust gas introduced into the oven body, and rotating of the exhaust fan assembly changes a position of the outlet with respect to the oven body, so as to direct the exhaust gas toward a desired direction.

12. The wall-mountable cooking apparatus of claim 11, wherein the exhaust fan assembly comprises:

a fan case;

an exhaust fan contained in the fan case; and a guide duct which is positioned toward a side face of the fan case, and guides the exhaust gas toward the fan case.

13. The wall-mountable cooking apparatus of claim 12, wherein the fan case includes an inlet formed on the side face.

14. The wall-mountable cooking apparatus of claim 13, herein the exhaust fan assembly further comprises a fan motor which drives the exhaust fan.

15. A wall-mountable cooking apparatus comprising:

an oven body having a discharging outlet formed thereon;

a heating unit to cook food; and an exhaust fan assembly which is coupled to the discharging outlet, protruding from the oven body, has openable/closeable outlet shutters, and has a fan case, wherein the fan case includes a lower portion which is disposed between a top wall of the cooking chamber and a top panel of the oven body, and communicates with the exhaust path; and an upper portion which protrudes from the top panel of the oven body, so as to increase a chamber dimension of the cooking chamber by a distance of the protrusion of the fan case.

16. The wall-mountable cooking apparatus of claim 15, wherein the protrusion of the exhaust fan assembly increases a chamber dimension of the cooking chamber.

17. The wall-mountable cooking apparatus of claim 15, wherein the one or more outlet shutters guide exhaust gas introduced into the oven body in response to being opened, and opening and closing of the one or more outlet shutters change a direction of the exhaust gas being guided.

18. The wall-mountable cooking apparatus of claim 17, wherein the exhaust fan assembly further comprises:

an exhaust fan contained in the fan case; and a guide duct which is positioned toward a side face of the fan case, and guides the exhaust gas toward the fan case.

19. The wall-mountable cooking apparatus of claim 18, wherein case includes an inlet formed on the side face.

20. The wall-mountable cooking apparatus of claim 19, the exhaust fan assembly further comprises a fan motor which drives the exhaust fan.

* * * * *

UNITED STATES PATENT AND TRADEMARK OFFICE

CERTIFICATE OF CORRECTION

PATENT NO. : 6,818,874 B2
DATED : November 16, 2004
INVENTOR(S) : Sang-Jin Jeong It is certified that error appears in the above-identified patent and that said Letters Patent is hereby corrected as shown below:

Title page,
Item [54], Title, change "WALL-MOUNTED TYPE MICROWAVE OVEN" to -- EXHAUST FAN ASSEMBLY FOR WALL-MOUNTED TYPE MICROWAVE OVEN --.

Column 8,
Line 29, change "herein" to -- wherein --;
Line 60, after "wherein" insert -- the fan --; and
Line 61, after "claim 19," insert -- wherein --.

Signed and Sealed this

Seventeenth Day of May, 2005

JON W. DUDAS
*Director of the United States Patent and Trademark Office*